United States Patent [19]

Cronkhite et al.

[11] Patent Number: 4,653,231

[45] Date of Patent: Mar. 31, 1987

[54] POLISHING SYSTEM WITH UNDERWATER BERNOULLI PICKUP

[75] Inventors: Paul W. Cronkhite, Scottsdale; Bruce C. Bosley, Mesa; James H. Jones, Phoenix; Asit G. Patel, Chandler, all of Ariz.

[73] Assignee: Motorola, Inc., Schaumburg, Ill.

[21] Appl. No.: 793,818

[22] Filed: Nov. 1, 1985

[51] Int. Cl.[4] ..... B24B 7/00

[52] U.S. Cl. ..... 51/5 R; 51/235; 51/418

[58] Field of Search ..... 51/5 R, 418, 215 HM, 51/235, 417, 317, 318; 134/51, 61, 63; 198/346.3; 294/64.1, 64.2

[56] References Cited

U.S. PATENT DOCUMENTS

| | | | |
|---|---|---|---|
| 3,701,222 | 10/1972 | Testolin | 51/317 |
| 3,993,301 | 11/1976 | Vits | 294/64.1 |
| 4,002,246 | 1/1977 | Brandt | 51/235 |
| 4,141,180 | 2/1979 | Gill | 51/124 R |
| 4,184,292 | 1/1980 | DeFazio et al. | 294/64.2 |
| 4,555,876 | 12/1985 | Ohtake | 51/418 |

*Primary Examiner*—Frederick R. Schmidt
*Assistant Examiner*—Bradley I. Vaught
*Attorney, Agent, or Firm*—Joe E. Barbee

[57] ABSTRACT

An automatic polishing system for polishing semiconductor material is described. A robot and Bernoulli pickup are used to retrieve polished wafers from an underwater unload station which is located on a wafer polisher. The polished wafer is then deposited into a cassette which is located underwater.

6 Claims, 4 Drawing Figures

POLISHING SYSTEM WITH UNDERWATER BERNOULLI PICKUP

BACKGROUND OF THE INVENTION

This invention relates in general, to semiconductor wafer processing equipment, and more particularly to an apparatus for polishing a semiconductor wafer made of silicon or other material that is used in the fabrication of a semiconductor device.

Semiconductor devices are manufactured on a substrate which is usually made from silicon or the like. The substrate or wafers, are sliced from ingots of various sizes. This slicing process causes surface damage and leaves the wafer with thickness variations and deviations from parallelism. To improve the wafer flatness and parallelism and eliminate saw marks and surface damage, the wafers are sent through a lapping or grinding, and an etching and polishing process.

The rough surface of a lapped wafer is usually etched to remove sub-surface damage, then polished to a flat mirror finish before the wafer is suitable for processing into semiconductor devices. The polished wafer must be free from defects and be extremely flat, especially when the wafer is used for sub-micron devices.

Polishing wafers is usually a two part process in which the first part, or primary polish, is stock removal. During primary polish, approximately 17 micrometers of material are removed from each wafer. During the next step, final polishing, only a very small amount of material is removed. Both primary polish and final polish are done on the same type of machine but with different slurries and pads. Since final polishing takes only about twenty percent of the time that primary polishing takes, there may be four or five primary polishing machines for each machine used for final polishing.

It was found that the existing polishing equipment was not capable of producing the high quality flat finish necessary for the starting material of a sophisticated integrated circuit. It was also found that over two percent of the wafers were damaged due to the manual handling of the wafers during the unloading of the primary polisher, transporting the wafers, and loading the final polisher.

A need therefore existed for an automatic polishing system that could do both the primary and the final polish and still produce large diameter, ultra flat, defect free wafers, with a minimum amount of operator handling.

SUMMARY OF THE INVENTION

Accordingly, it is an object of the present invention to provide an improved apparatus for polishing a semiconductor wafer or a workpiece.

Another object of this invention is to decrease or eliminate rejected wafers due to defects or breakage.

An additional object of the present invention is to polish a semiconductor wafer to a high degree of precision, accuracy, and flatness control.

The foregoing and other objects and advantages are achieved in the present invention which, as part thereof, makes use of a robot and attached Bernoulli pickup. The robot and Bernoulli pickup are used to transfer wafers from load and unload stations on a wafer cassette handling system to load and unload stations of a plurality of wafer polishers.

A more complete understanding of the present invention can be attained by considering the following detailed description in conjunction with the accompanying drawings.

DETAILED DESCRIPTION OF THE DRAWINGS

Figure 1:
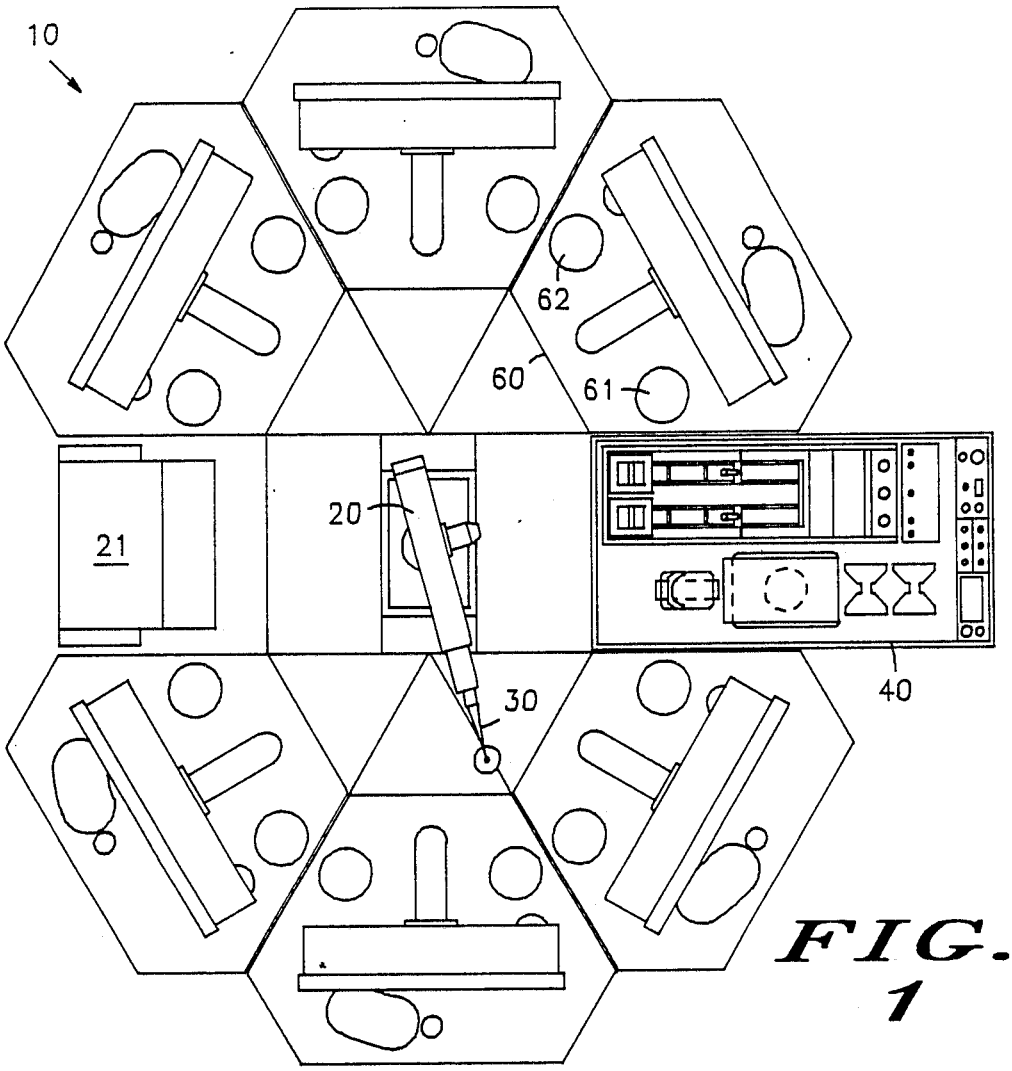
FIG. 1 illustrates a top view of a wafer polishing system in accordance with the present invention.

FIG. 1 is a top view of a polishing system that automatically polishes semiconductor wafers or similar workpieces. Polishing system 10 uses robot 20 with Bernoulli pickup 30 to transfer wafers from cassette wafer handling system 40 to six single head wafer polishers 60.

Robot 20 may be a model Maker 100/2 robot which is made commercially available by U.S. Robot of King of Prussia, Pa. Robot 20 is programed by robot control console 21 to transport wafers to load station 61 and pickup wafers from unload station 62 on the individual polishers. Control console 21 also identifies wafers, ready for pickup by robot 20, in position on a receiver or load station located on wafer handling system 40.

Figure 2:
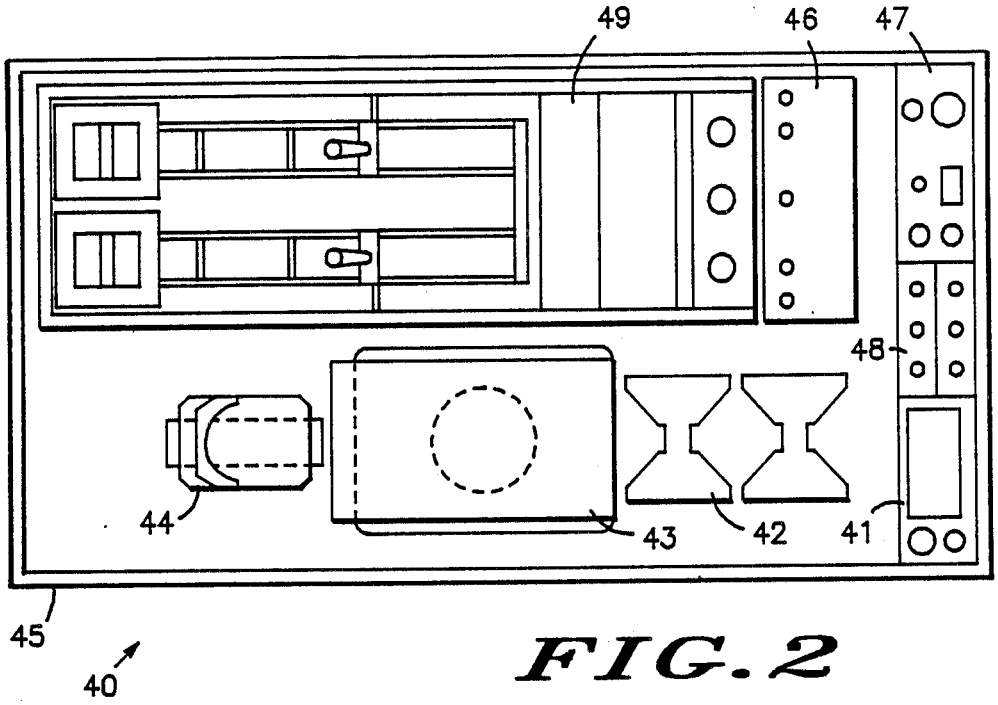
FIG. 2 illustrates a top view of a wafer cassette handling system used in the wafer polishing system of FIG. 1.

Wafer cassette handling system 40, as illustrated in FIG. 2, is a modified scrubber from Silicon Valley Group of San Jose, Calif. Scrubber panel 41, cassette holders 42, and brush scrubber 43 are the only part of the original equipment. Scrubber panel 41 was originally mounted to the side of cabinet 45 but was moved to the location shown in FIG. 2. Slurry fail system 48 prevents polishers 60 from trying to polish wafers without slurry which would damage or break the wafers. Fail system 48 consists of fail lights, reset buttons and silence buttons for the primary and final slurries. Also included are pressure switches and interconnects to each polisher computer.

Gauge panel 47 shows pressure settings for brush scrubber 43. Reset panel assembly 46 is used to notify the operator that a cassette located in load assembly 49 is full of waters. This stops robot 20 from placing additional wafers into the cassette. Once the full cassette is replaced with an empty one a reset button on panel 46 is activated to resume operation. Load assembly 49 is illustrated in greater detail in FIG. 3.

Figure 3:
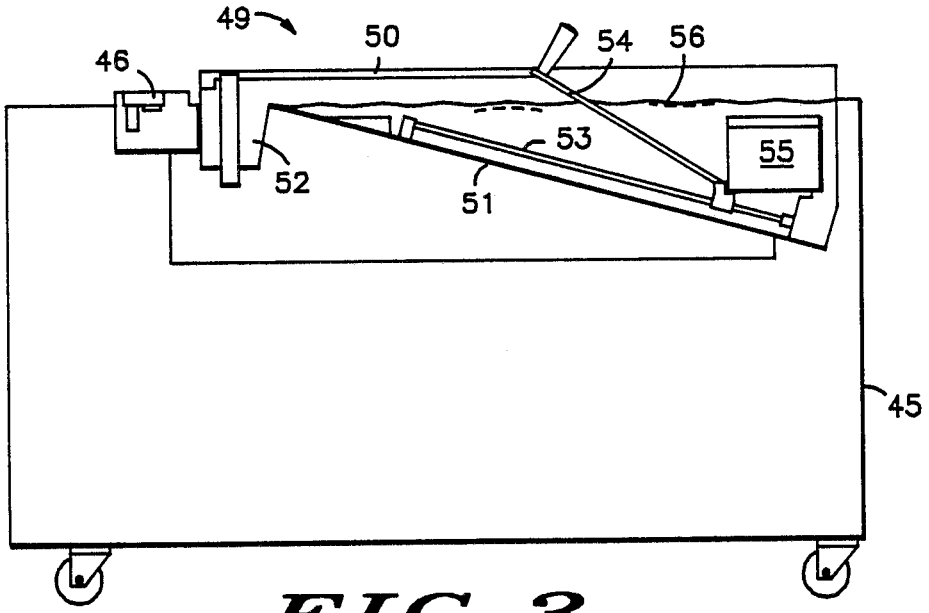
FIG. 3 illustrates a side view of an underwater load station that is located in the wafer cassette handling system of FIG. 2.

FIG. 3 illustrates load assembly 49 comprising of stainless steel trough 50 with slopping bottom 51 and overflow well 52. Mounted to bottom 51 are guide rods 53. Mounted to guide rods 53 and free to slide the length of rods 53 are handle assemblies 54 and carriage assemblies 55. Wafer cassettes are placed in carriage assemblies 55 for receiving wafers from robot 20. Trough 50 is filled with deionized water (D.I.) up to water level 56 thus submersing carriage assemblies 55. The D.I. water is filtered and recirculated by a pump located below trough 50.

Friction polisher 60 (FIG. 1) uses a servo driven polishing arm that is mounted to a cabinet. Connected to the polishing arm is a workpiece holder, sometimes referred to as a wafer chuck. Adjacent to the polishing arm is load station 61 which positions the work piece or wafer for pick-up by the polishing arm and attached wafer chuck. Next to the load station is a brush station which automatically cleans the grooves in the wafer chuck prior to picking up the next wafer. Mounted to the cabinet, next to the brush station, is a primary polish station which is used to remove the majority of the rough material. Alongside of the primary polish station is a final polish station used to provide a finished surface to the wafer. At the completion of the polish cycle the polishing arm discharges the polished wafer into unload station 62 which is located next to the final polish station. A more detailed description of polisher 60 can be found in co-pending application Ser. No. 779,339, entitled Apparatus For Polishing Semiconductor Wafers.

Figure 4:
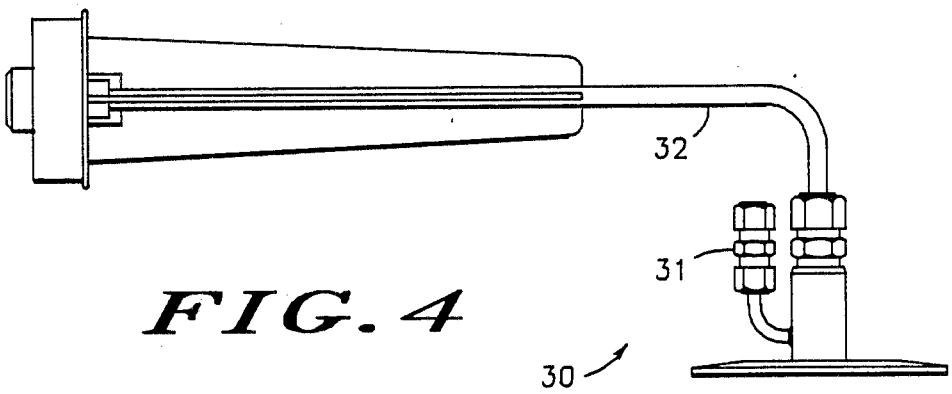
FIG. 4 illustrates a side view of a Bernoulli pickup used in the wafer polishing system of FIG. 1.

FIG. 4 illustrates Bernoulli pickup 30 which is attached to an arm of robot 20 and is used in conjunction with robot 20 to transfer wafers from station to station. A flexible line is connected to pickup 30 by union 31. This line is used for low pressure air. Stainless steel tubing 32 is used to carry vacuum, low volume D.I. water and high volume D.I. water.

In the present form of the invention, one or two cassettes of wafers are placed in cassette holders 42 (FIG. 2) where wafers are automatically fed through brush scrubber 43, which cleans the back side of the wafer. Scrubber 43 then passes the wafer to unload station 44. Incorporated into the bottom of station 44 is a fiber optic sensor which sends a signal to robot 20 that a wafer is ready for pick-up. Robot 20 picks up the wafer using a vacuum and Bernoulli pickup 30 (FIG. 1). Moving in either direction, robot 20 deposits the wafer in the first empty load station 61 of active polishers 60. Only one polisher need be operational for robot 20 to be functional. Once robot 20 has delivered a wafer to load station 61, polisher 60, with its own independent computer system, cleans the backside of the wafer, polishes the frontside of the wafer with the primary and final polish pads, and delivers the wafer to unload station 62.

A wafer that is placed in unload station 62 is suspended in water by jets of water emanating from the bottom of station 62. Also located in the bottom, is a fiber optic sensor which signals robot 20 that a wafer is ready for pickup. The wafer is suspended in unload station 62 to prevent the polished surface, which is facing down, from getting damaged. To prevent scratches, robot 20 is programed to stop pickup 30 below the surface of the water in station 62, just above the wafer. A high pressure stream of water is emitted from pickup 30 for six seconds. Because of the Bernoulli effect, a low pressure area is created between the wafer and pickup 30 which causes the wafer to be drawn up next to pickup 30. After the six seconds the stream of water is turned off and vacuum is turned on. The wafer is closed enough to pickup 30 to make a positive contact.

After retrieving the wafer from unload station 62, robot 20 repositions itself in front of wafer handling system 40 and deposits the wafer into one of the two cassettes in underwater load station 49. Robot 20 loads the cassettes by positioning pickup 30 approximately 1.5 inches directly above the slot to be filled. To release the wafer, the vacuum is turned off and a low pressure stream of water is sent through pickup 30. The wafer slides down pickup 30 into a slot of the cassette. Keeping count of the wafers, robot 20 will load the first cassette until full and then start loading the second cassette. When the first cassette is full of polished wafers, robot 20 notifies the operator through an audio/visual signal on panel assembly 46. Using handle assembly 54 the full cassette is withdrawn from the water and placed in a spin dryer. An empty cassette is placed in carriage assembly 55 and returned to the lowered position in the water. To resume loading of the empty cassette, a reset button on reset panel assembly 46 is activated.

Thus, it is apparent that there has been provided an improved apparatus for polishing semiconductor material. This is accomplished in part with the use of a robot and attached Bernoulli pickup, and a wafer cassette handling system, with an underwater load station.

What is claimed is:

1. Apparatus for polishing a semiconductor wafer, comprising:

a robot having an arm;

a Bernoulli pickup attached to the arm of the robot;

a wafer cassette handling system with a load station that is located underwater; and a plurality of wafer polishers with unload stations capable of containing water so that the wafers can be unloaded at the unload stations underwater, wherein the Bernoulli pickup is used to transfer wafers from the unload stations of the polishers to the load station of the wafer handling system.

2. Apparatus for polishing a semiconductor wafer, comprising:

a plurality of wafer polishers with load and unload stations;

a wafer cassette handling system with load and unload stations comprising a wafer scrubber and an underwater load station; and a Bernoulli pickup which is used to transfer wafers from the load and unload stations of the wafer polisher to the load and unload stations of the wafer cassette handling system.

3. Apparatus in accordance with claim 2 wherein the Bernoulli pickup secures the wafer from the unload station of the polisher and deposits it into the underwater load station.

4. Apparatus for polishing a semiconductor wafer, comprising:

a wafer cassette handling system having a brush scrubber and an underwater load station;

a plurality of wafer polishers with load and unload stations; and means for transferring wafers from the brush scrubber to the load station of each of the wafer polishers, the means for transferring wafers also being used to transfer wafers from the unload station of each of the wafer polishers to the underwater load station of the wafer cassette handling system.

5. Apparatus in accordance with claim 4 wherein the underwater load station of the wafer cassette handling system comprises:

a trough with a sloping bottom;

a guide rod mounted to the bottom of the trough a handle assembly mounted to the guide rod; and a carriage assembly mounted to the handle assembly.

6. Apparatus in accordance with claim 5 wherein the carriage assembly is capable of containing water.

* * * * *